US005081772A

United States Patent [19]

Wyman

[11] Patent Number: 5,081,772

[45] Date of Patent: Jan. 21, 1992

[54] CONDENSATION VAPOR DEGREASER

[75] Inventor: Donald P. Wyman, Fairport, N.Y.

[73] Assignee: Rochester Midland Corporation, Rochester, N.Y.

[21] Appl. No.: 524,469

[22] Filed: May 17, 1990

[51] Int. Cl.[5] ..... F26B 21/06

[52] U.S. Cl. ..... 34/79; 34/73; 134/40

[58] Field of Search ..... 34/17, 60, 61, 12, 73, 34/78; 134/40, 105, 109; 202/170

[56] References Cited

U.S. PATENT DOCUMENTS 2,089,102 8/1937 Savage .
3,881,949 5/1975 Brock .
4,029,517 6/1977 Rand .
4,101,340 7/1978 Rand .
4,442,851 4/1984 Holm .
4,486,239 12/1984 du Fresne .
4,612,712 9/1986 Pescatore et al. .

*Primary Examiner*—Henry A. Bennett
*Attorney, Agent, or Firm*—Eugene Stephens & Associates

[57] ABSTRACT

A condensation vapor degreaser for cleaning soiled parts includes two separate paths for connecting a solvent chamber to a condenser. A primary path connects the solvent chamber directly to the condenser. A secondary path extends through a cleaning chamber. The primary path is opened and the secondary path is closed to permit the parts to be inserted or removed from the cleaning chamber while generating solvent vapors in the solvent chamber.

28 Claims, 2 Drawing Sheets

CONDENSATION VAPOR DEGREASER

BACKGROUND

Condensation vapor degreasers have been used for many years to remove oils, greases, and related organic soils from metal or plastic parts. Typically, a solvent is heated within a solvent chamber for producing hot vapors that engulf parts suspended within a cleaning chamber. The hot vapors condense onto the surface of the parts and dissolve the soils on their surfaces. The soils are thereby suspended in the condensed solvent and are returned by gravity to the solvent chamber.

One advantage of using solvent vapors for cleaning parts compared to submerging parts within a solvent bath is that the solvent vapors remain substantially free of the soils which become suspended in the solvent. The clean solvent vapors are distilled from the solvent soil solution. Other related advantages include the use of only a small amount of solvent to clean large numbers of parts and the use of elevated temperatures to accelerate the rate of soil dissolution into the solvent.

Well-known criteria are used to select solvents for vapor degreasing operations. First, the solvents should be effective for dissolving the type of soils to be cleaned. Second, the solvents should exhibit low specific heats and relatively low heats of vaporization so that energy requirements for raising the temperature of the solvents and for vaporizing the solvents are minimized. Third, the solvents should boil at the lowest temperatures which are effective for dissolving the soils so that the parts can be conveniently handled and energy expenditures are further minimized. Fourth, the solvent vapors should condense easily and dry quickly, leaving no residues. Finally, it has been a longstanding criteria to select solvents that exhibit relatively high flash points to avoid the possibility of igniting the vapors during the insertion or removal of parts from a cleaning chamber.

The most widely used solvents are halogenated hydrocarbon solvents. In particular, most solvents used in vapor degreasing operations are chlorinated or fluorinated hydrocarbons. Although these compounds exhibit very favorable characteristics for use as degreasing solvents, they are also known to be hazardous chemicals. The chlorinated hydrocarbons have been identified as a potential human carcinogen and the fluorinated hydrocarbons have been blamed for damaging the earth's ozone layer. Neither of these types of halogenated hydrocarbons is biodegradable, and they tend to persist in the environment as a toxin to fish and other wildlife.

Various attempts have been made to limit the exposure of operators and the environment: to these hazardous chemicals by modifying conventional vapor degreasers to reduce the amount of vapors which can escape from the cleaning chamber when parts are inserted or removed. For example, U.S. Pat. Nos. 4,029,517 and 4,101,340 to Rand disclose special apparatus for removing solvent vapors prior to opening the cleaning chamber. Of course, in addition to removing vapors already present in the cleaning chamber, it is necessary to prevent additional vapors from entering the heating chamber. Accordingly, the known apparatus also provides for shutting off the supply of heat to the solvent chamber and for isolating the cleaning chamber from the solvent chamber.

Although the known apparatus significantly reduces vapor losses from the cleaning chamber, the process of removing cleaned parts and inserting new ones is very time consuming because the cleaning chamber must remain closed until the solvent has cooled beneath its boiling point. The solvent must also be reheated every time a new part is added, and this takes additional time and energy to revaporize the solvent. Of course, even if such time-consuming procedures are used to minimize vapor losses during the degreasing process, special care is still required for adding or removing the solvent from the degreaser, and for storing and disposing of the solvent after use.

Other solvent compounds, particularly hydrocarbon solvents, are known to exhibit good cleaning qualities and to pose less long-term risk to human health and the environment, but they also exhibit detectable flash points. In other words, the known hydrocarbon solvents pose a significant safety hazard in the form of a risk of explosion and fire when present in only limited concentrations in the air. Accordingly, the hydrocarbon solvents are seldom used in vapor degreasing operations; and in the limited instances in which they are used, they are contained in special concentrations with other substances which minimize the potential of the vaporized solvent to explode.

SUMMARY OF THE INVENTION

Our invention provides a new condensation vapor degreasing apparatus which significantly reduces the amount of time required to clear a cleaning chamber of solvent vapors. Accordingly, our invention provides a much more practical and economical way of reducing the risk of solvent vapors escaping from the cleaning chamber.

Although our invention may be used to limit the exposure of operators and the environment to the hazards of halogenated solvents, our invention also provides for safely using hydrocarbon solvents which pose much less long-term risk to operators and the environment. Even though the hydrocarbon solvents exhibit detectable flash points, our invention provides for limiting airborne concentrations of the hydrocarbon solvents to beneath their lower explosion limit.

Our new condensation vapor degreaser includes a cleaning chamber and a solvent chamber. A heater is provided in the solvent chamber to vaporize quantities of the solvent for cleaning parts in the cleaning chamber. The cleaning chamber and the solvent chamber are connected by a valve which permits an exchange of solvent vapor and condensed solvent between the chambers. However, both the cleaning chamber and the solvent chamber are also connected to a condenser by a pair of specially controlled valves.

The valve between the cleaning chamber and the solvent chamber is opened to allow heated vapors to enter the cleaning chamber and to return to the solvent chamber in condensed form. The valve between the cleaning chamber and the condenser is also opened to avoid the accumulation of pressure within the solvent and cleaning chambers. Preferably, the condenser is vented to atmosphere through an absorption bed which prevents any residual solvent or vapor which might pass through the condenser from escaping to the environment.

During the cleaning operation, the valve between the solvent chamber and the condenser remains closed. This forces the vapors generated in the solvent chamber to pass through the cleaning chamber on route to the condenser. However, once a part has been cleaned, the valve between the cleaning chamber and condenser is closed and the valve between the solvent chamber and condenser is opened to provide a more direct route for relieving vapor pressure from the solvent chamber. Any condensed solvent remaining on parts in the cleaning chamber is allowed to drain for a short period of time through the valve connecting the cleaning chamber and solvent chamber. After that, the valve connecting the two chambers is also closed, thereby isolating the cleaning chamber from the solvent chamber.

Preferably, inlet and outlet valves to the cleaning chamber are then opened to purge any remaining vapor from the cleaning chamber. The purge gas, for example, nitrogen, carries away the residual solvent vapors to the absorption bed. Thereafter, the door of the cleaning chamber may be opened for removing the clean parts and inserting dirty ones.

Most importantly, our new degreasing apparatus provides for applying a continuous supply of heat to the solvent chamber while opening or closing the cleaning chamber. This feature greatly reduces the amount of time that must be expended between cleaning operations on different batches of parts. Vapors are continuously generated by the heat applied to the solvent, but the vapors and solvent may be exchanged between the condenser and solvent chamber independently of the connection between the solvent and cleaning chambers or between the cleaning chamber and condenser. In other words, it is possible to clear the cleaning chamber of vapors while continuing to generate solvent vapors in the solvent chamber. Moreover, once a batch of new parts has been inserted into the cleaning chamber, solvent vapors are immediately available for cleaning the parts. This is accomplished by opening the valves which interconnect the cleaning chamber to the solvent chamber and condenser, and thereafter closing off the valve connecting the solvent chamber more directly to the condenser.

Our new vapor degreaser is especially suitable for use with hydrocarbon solvents that exhibit comparable specific heats, heats of vaporization, and boiling points to conventional halogenated solvent compounds. Although the hydrocarbon solvents may also exhibit detectable flash points, our degreaser provides for clearing any dangerous concentrations of vapors from the cleaning chamber before opening the chamber to the surrounding environment.

The preferred hydrocarbon solvents are selected from a group including linear and branched aliphatic hydrocarbons, mineral spirits, aromatic hydrocarbons, terpenes, linear and branched olefins, cyclic olefins, and alicyclic and aliphatic hydrocarbons. All of these solvents exhibit favorable properties for dissolving one or more different types of soils and pose significantly reduced risks to the health of operators. The above-named olefins, especially the linear and cyclic olefins, are particularly preferred because of their biodegradable qualities. Other non-hydrocarbon solvents that may also be safely used in the present invention are esters, ketones, and alcohols. Although the suggested alternative solvents exhibit detectable flash points, this characteristic enables used solvent-soil solutions to be effectively disposed of by combustion.

DRAWINGS

DETAILED DESCRIPTION

Figure 1:
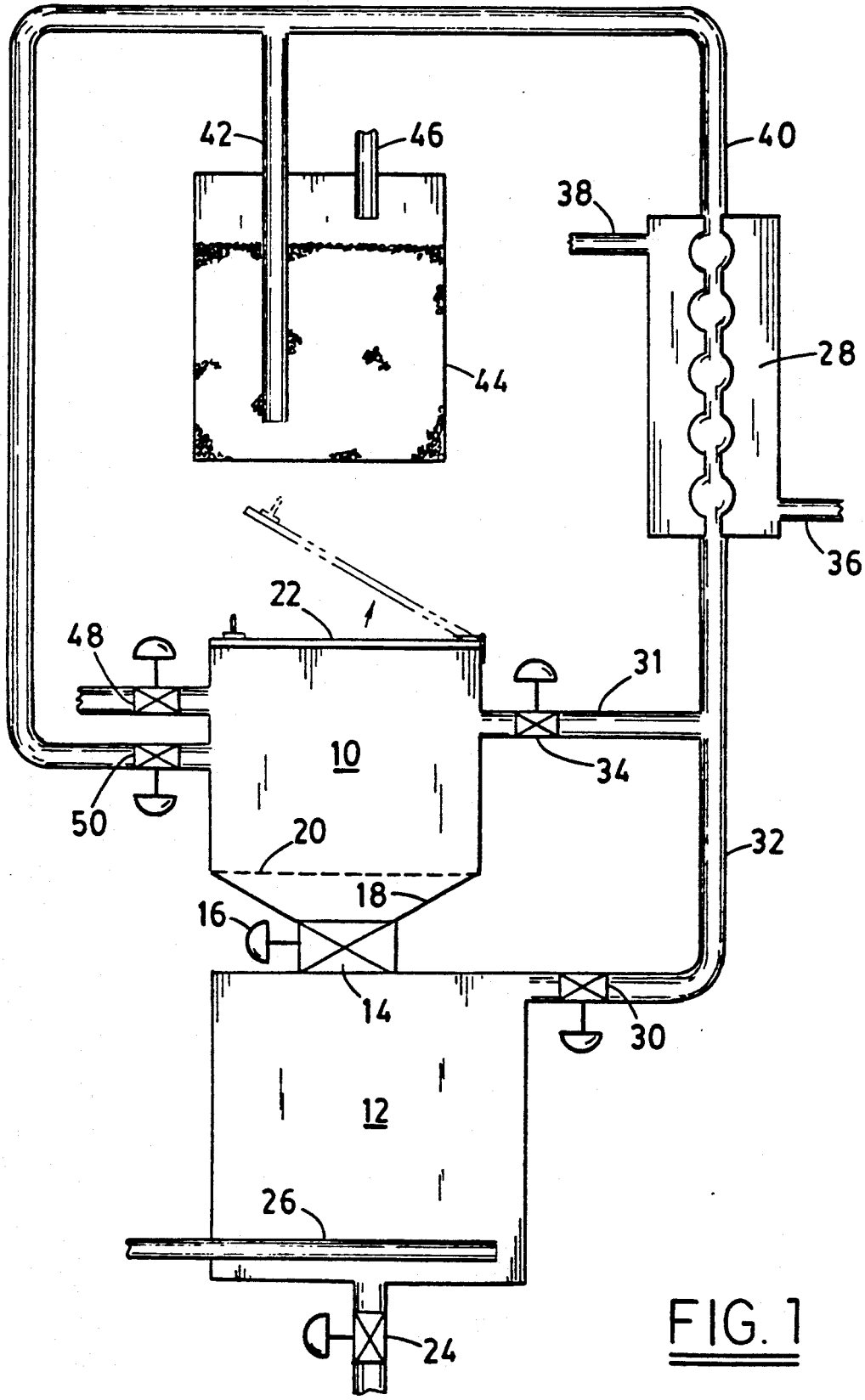
FIG. 1 is a schematic view of our novel condensation vapor degreaser.

Our new condensation vapor degreaser is depicted schematically in FIG. 1 to emphasize the important features of our invention. None of the components which are so depicted are new per se, and the particular details of such components are well known. However, the components are combined and interrelated in a novel manner which permits many advantages which were heretofore not possible with known arrangements of condensation vapor degreasing apparatus.

Cleaning chamber 10 is mounted above solvent chamber 12, and the two chambers are interconnected by valve 14. This valve, like others to be referenced, includes means 16 for opening and closing the valve. Although the means 16 is depicted as a manually operated handle, the referenced valves may also be operated electrically in accordance with customary practices of the art. Cleaning chamber 12 also includes a bottom surface 18 which is shaped to promote drainage of condensed solvent through valve 14. A grate 20 or similar means may be used to suspend parts within chamber 10. The top end of cleaning chamber 12 is enclosed by door 22 that includes suitable gaskets and mechanical latches (not shown) for sealing the open end of the cleaning chamber to prevent the ingress of air or the escape of solvent vapors from the cleaning chamber. Of course, suitable known means are also used for opening and closing the door.

Solvent chamber 12 is preferably fabricated from stainless steel, mild steel, aluminum, or other materials which are not affected by organic solvents at their boiling points. Drainage valve 24 is connected to the bottom of the solvent chamber to permit used solvent to be drained from the chamber. A heater 26 is also provided in the bottom of solvent chamber 12 to provide a source of heat to vaporize the solvent. The heater may be any one of a number of known types including electric immersion heaters, steam coil heaters, or a hot plate.

Both the cleaning chamber 10 and the solvent chamber 12 are connected to condenser 28. Cleaning chamber 10 is connected to the condenser 28 through valve 34 in conduit 31 and through a portion of conduit 32. Solvent chamber 12 is connected to condenser 28 via valve 30 and the full length conduit 32. Thus, two paths are provided for vapors to escape from the solvent chamber. One path defines a secondary passageway that extends through valve 14, cleaning chamber 10, valve 34, and conduits 31 and 32. The other path defines a primary passageway that extends through the valve 30 and conduit 32. The primary passageway is a much more direct route to the condenser through which a majority of the vapors escape, even when both passageways are open.

Although both passageways conduct vapors from the solvent chamber to the condenser, only the primary passageway provides for returning condensed solvent from the condenser to the solvent chamber. The returning solvent is diverted away from the cleaning chamber by a "T-shaped" fitting which joins conduits 31 and 32.

Condenser 28 has respective inlet and outlet passages 36 and 38 that transmit cold water or other heat transfer fluids through the condenser. A pump (not shown) may be used to circulate the fluid through the condenser. The condenser is preferably constructed from a material which is impervious to solvents; and although various shapes of the condenser may be used including the bulb-type shape schematically depicted, it is important that the condenser shape results in sufficient turbulent flow of the vapors to ensure a high probability that vapor molecules will contact the condenser surface. Alternatively, it would be possible to substitute a heat exchanger for the condenser to more efficiently condense the vapors.

An output port 40 of the condenser is connected to an inlet pipe 42 of absorption bed 44. The absorption bed 44 also has an outlet 46 which retains the absorption bed and condenser at atmospheric pressure. Various materials may be used in the absorption bed, including activated carbon, for capturing any small amounts of solvent or solvent vapor which might escape through the condenser.

Finally, respective inlet and outlet valves 48 and 50 provide for admitting and exhausting a purge gas to and from the cleaning chamber. The purge gas is preferably an inert gas, such as nitrogen, that may be used to sweep out solvent vapors from the cleaning chamber. A suitable pump (not shown) may be used to provide a source of pressurized gas to inlet valve 48. Outlet valve 50 exhausts the gas through inlet pipe 42 of the absorption bed. In this way, any of the vapors which are swept out by the inert gas are captured in the absorption bed.

A number of novel procedures are used for operating our novel vapor degreaser. The procedures include a start-up cycle, an operating cycle, and a cycle for removing and inserting new parts.

For starting up our novel vapor degreaser, an appropriate amount of solvent is added to the solvent chamber. This may be accomplished by pouring the solvent through open door 22 and valve 14 into the solvent chamber. Of course, the drainage valve 24 is closed before adding the solvent. Next, coolant flow is established through the condenser. Valve 14 between the solvent chamber and cleaning chamber is closed, and the valve 30 between the solvent chamber and the condenser is opened. The valve 34 is also closed to completely isolate the cleaning chamber from the solvent chamber. Lastly, the heater 26 is turned on to raise the temperature of the solvent to its boiling point. Vapors given off by the solvent are carried by conduit 32 into contact with condenser 28 and are returned as condensed solvent to the solvent chamber via the same conduit.

Once solvent vapors and condensed solvent are being exchanged between the solvent chamber and condenser, the vapor degreaser is ready to begin an operating cycle for cleaning parts. The parts are placed in the cleaning chamber through open door 22 and may be suspended within the chamber on grating 20. Thereafter, the door 22 is closed and sealed tightly shut. Purge valves 48 and 50 are also closed. Next, the valve 14 between the solvent chamber and the cleaning chamber is opened along with the valve 34 between the cleaning chamber and the condenser. Once those two valves have been opened, the valve 30 between the solvent chamber and the condenser can be closed. This blocks off the primary path for solvent vapors to escape from the solvent chamber to the condenser and forces the solvent vapors to escape through the cleaning chamber.

At all times during which heat is applied to the solvent chamber, at least one path between the solvent chamber and the condenser remains open. Accordingly, any time the valve 30 is closed, both valves 14 and 34 must be open to permit the solvent vapors to escape through the cleaning chamber to the condenser. The solvent vapors which enter the cleaning chamber engulf the suspended parts. Any of the solvent which condenses onto the parts, thereby washing their surfaces, is drained from the parts and the cleaning chamber back through the valve 14 into the solvent chamber. Thus, the parts act as a condenser within the cleaning chamber for exchanging solvent vapor and condensed solvent with the solvent chamber. However, any solvent that is condensed by condenser 28 is not immediately returned to the solvent chamber, but is temporarily collected in conduit 32 above closed valve 30.

Once the parts have been adequately cleaned, a cycle is provided for removing the cleaned parts and for readying the apparatus to receive a next batch of dirty parts. Before door 22 can be opened to exchange the parts, the solvent vapors must be evacuated from the cleaning chamber. The first step of accomplishing this involves opening the valve 30 to provide a primary path for solvent vapors to escape from the solvent chamber. The condensed solvent which has collected in the conduit 32 is returned through the opened valve 30 to the solvent chamber. With the primary path between the solvent chamber and condenser established, the valve 34 between the cleaning chamber and the condenser is closed to prevent any vapors in conduit 32 from entering the cleaning chamber. For a short period of time, condensed solvent within the cleaning chamber is allowed to drain back to the solvent chamber through valve 14. Thereafter, the valve 14 is closed for completely isolating the cleaning chamber from the solvent chamber.

Any residual solvent vapors which remain in the cleaning chamber are evacuated by a purge gas which is pumped under pressure through opened inlet valve 48 and is exhausted together with the residual vapors through opened outlet valve 50. The absorption bed, which collects the residual vapors, also maintains the cleaning chamber at atmospheric pressure during the purging operation. Otherwise, the condensation of solvent vapor within the cleaning chamber could create a vacuum which would make the door very difficult to open. Once the cleaning chamber is purged of residual vapors, the door 22 may be safely opened to remove the cleaned parts and to insert the dirty ones.

From start-up through subsequent operations on batches of parts, solvent in the solvent chamber receives a continuous supply of heat. It is particularly advantageous that heat is supplied even while the door of the cleaning chamber is opened. This saves a considerable amount of time and energy that would be wasted reheating the solvent. The solvent vapors, which are generated while the door is opened, are completely isolated from the cleaning chamber; and this prevents the vapors from escaping or posing any sort of risk to the operator or environment.

Although it would be possible to use conventional halogenated hydrocarbon solvents with less risk during the operation of our condenser, these solvents still pose significant problems with handling and disposal. Accordingly, it is preferred to operate our vapor degreaser with non-hydrogenated hydrocarbon solvents that pose less risk to operators or the environment and that may be disposed of by combustion. Other alternative solvents such as esters, ketones, and alcohols may be used with similar advantages.

Figure 2:
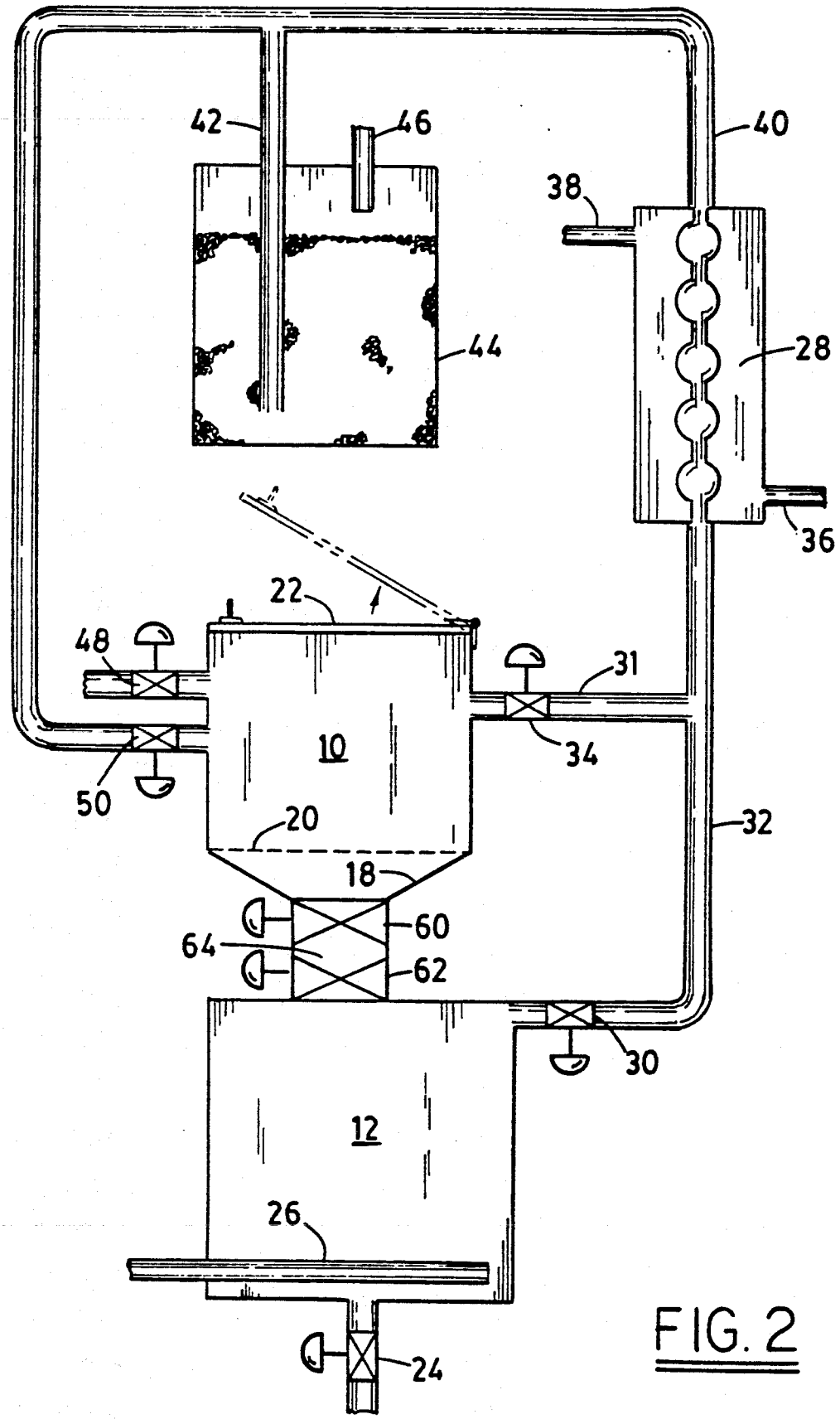
FIG. 2 is a variation of the degreaser of FIG. 1 showing alternative means for interconnecting a solvent chamber and cleaning chamber.

An alternative embodiment of our vapor degreaser is shown in FIG. 2. Like reference numerals have been used to identify features of this embodiment which are common to the above-described vapor degreaser shown in FIG. 1. The only change is in the region which interconnects the cleaning chamber 10 with the solvent chamber 12. Instead of interconnecting the chambers through a single valve, the alternative embodiment provides for this purpose two valves 60 and 62 which are separated by a short conduit 64. The two valves 60 and 62 provide for respectively isolating the cleaning and solvent chambers from the conduit 64. Thus, either valve 60 or 62 may be used to isolate the two chambers from each other through conduit 64.

During the cleaning process, both valves 60 and 62 are open, enabling vapors from the solvent chamber to pass through the conduit 64 into the cleaning chamber. However, once the cleaning process has been completed and the valve 30 between the solvent chamber and condenser 28 is opened, the valve 62 may be closed for blocking the passage of any more solvent vapors into cleaning chamber 10. Although most of the vapors generated in solvent chamber 12 are expected to escape through the valve 30 of the primary passageway to the condenser, some excess vapors may remain in the solvent chamber which could enter the cleaning chamber unless at least one of the valves 60 or 62 is closed.

However, the valve 60 is maintained in an open state for a period of time, allowing the cleaning chamber to drain into the conduit 64. Once the cleaning chamber has drained of condensed solvent, the valve 60 is closed and the valve 62 is opened to return the drained solvent to the solvent chamber. Throughout the draining process, at least one of the valves 60 and 62 is closed to prevent any new vapors from entering the cleaning chamber. This feature of using two valves to interconnect the solvent and cleaning chambers may be used to speed up both the draining and purging processes so that door 22 can be safely opened a little sooner.

Many other variations will also be apparent to those of skill in the art in accordance with the teaching of the present invention. For example, instead of using a single condenser (or heat exchanger), it would be possible to connect the solvent chamber and cleaning chamber to separate condensers. Also, the entire operation of our vapor degreaser including the loading and unloading of parts may be completely automated in accordance with the ordinary practices of the art.

We claim:

1. A condensation vapor degreaser comprising:

a solvent chamber for containing a supply of solvent;

a cleaning chamber for cleaning parts with vaporized solvent;

a heater for vaporizing solvent in the solvent chamber;

a door for inserting parts into said cleaning chamber and for removing parts from said cleaning chamber;

a condenser for condensing solvent vapors;

a first valve connecting said solvent chamber to said cleaning chamber;

a second valve connecting said solvent chamber to said condenser;

a third valve connecting said cleaning chamber to said condenser; and valve operating means for closing said first and third valves and opening said second valve to isolate said cleaning chamber from solvent vapors and condensed solvent exchanged between said solvent chamber and said condenser.

2. The condensation vapor degreaser of claim 1 further comprising an absorption bed connected to said condenser for absorbing residual vapors passing through said condenser and for venting said condenser to atmosphere.

3. The condensation vapor degreaser of claim 2 further comprising respective inlet and outlet purge valves for admitting a pressurized inert gas into said cleaning chamber and for exhausting the gas from said cleaning chamber.

4. The condensation vapor degreaser of claim 3 further comprising an intake pipe for connecting both said condenser and said outlet purge valve to said absorption bed.

5. The condensation vapor degreaser of claim 1 wherein said valve operating means includes means for opening said second valve in advance of closing said first and third valves.

6. The condensation vapor degreaser of claim 5 wherein said valve operating means includes means for opening said first and third valves and closing said second valve for forcing solvent vapors to escape from said solvent chamber to said condenser through said cleaning chamber.

7. The condensation vapor degreaser of claim 6 wherein said valve operating means includes means for opening said first and third valves in advance of closing said second valve.

8. The condensation vapor degreaser of claim 1 wherein said first valve is separated from a fourth valve by a conduit for connecting said solvent chamber to said cleaning chamber.

9. The condensation vapor degreaser of claim 8 wherein said valve operating means includes means for closing said fourth valve to prevent solvent vapors in said solvent chamber from entering said conduit and for opening said first valve to drain condensed solvent from said cleaning chamber into said conduit.

10. The condensation vapor degreaser of claim 9 wherein said valve operating means includes further means for opening said fourth valve to drain the condensed solvent from the conduit into said solvent chamber and for closing said first valve to prevent solvent vapors in said conduit from entering said cleaning chamber.

11. A condensation vapor degreaser for cleaning parts comprising:

a solvent chamber for containing a supply of solvent;

a heater for vaporizing solvent contained within said solvent chamber;

a cleaning chamber for exposing parts to solvent vapors;

a condenser for condensing solvent vapors;

a primary passageway connecting said solvent chamber to said condenser independently of said cleaning chamber; and a secondary passageway extending through said cleaning chamber connecting said solvent chamber to said condenser wherein both of said passageways convey solvent vapors from said solvent chamber to said condenser.

12. The condensation vapor degreaser of claim 11 further comprising a first valve between said solvent chamber and said cleaning chamber for opening and closing a portion of said secondary passageway.

13. The condensation vapor degreaser of claim 12 further comprising a second valve between said solvent chamber and said condenser for opening and closing said primary passageway.

14. The condensation vapor degreaser of claim 13 further comprising valve operating means for opening said primary passageway between the solvent chamber and condenser and for closing off the portion of said secondary passageway between the solvent chamber and cleaning chamber.

15. The condensation vapor degreaser of claim 14 further comprising a third valve between said cleaning chamber and said condenser for opening and closing another portion of said secondary passageway.

16. The condensation vapor degreaser of claim 15 wherein said valve operating means further provides for closing off another portion of said secondary passageway between the solvent chamber and cleaning chamber.

17. The condensation vapor degreaser of claim 16 wherein said valve operating means further provides for opening at least one of said first and third valves and said second valve when said sufficient amount of heat is furnished to solvent contained in the solvent chamber.

18. The condensation vapor degreaser of claim 11 wherein said secondary passageway is more restricted than said first passageway so that when both said primary passageway and said secondary passageway are open, more solvent vapor escapes from said solvent chamber to said condenser through said primary passageway than through said secondary passageway.

19. The condensation vapor degreaser of claim 11 further comprising two valves separated by a conduit interconnecting said solvent chamber and said cleaning chamber, each of said valves providing for opening and closing respective portions of said secondary passageway.

20. The condensation vapor degreaser of claim 19 further comprising valve operating means for opening said primary passageway and closing a portion of said secondary passageway between said solvent chamber and said conduit.

21. The condensation vapor degreaser of claim 20 wherein said valve operating means includes means for closing a portion of said secondary passageway between said cleaning chamber and conduit and opening said portion of the secondary passageway between the solvent chamber and conduit.

22. The condensation vapor degreaser of claim 11 wherein said solvent chamber contains a supply of solvent having a detectable flash point that may be disposed of by combustion.

23. The condensation vapor degreaser of claim 22 wherein said solvent is a hydrocarbon solvent selected from a group consisting of linear and branched aliphatic hydrocarbons, mineral spirits, aromatic hydrocarbons, terpenes, linear and branched olefins, cyclic olefins, or alicyclic aliphatic hydrocarbons.

24. The condensation vapor degreaser of claim 22 wherein said solvent is selected from a group of solvents consisting of esters, ketones, and alcohols.

25. The condensation vapor degreaser of claim 18 wherein solvent vapors conveyed to said condenser through said primary and secondary passageways are returned to said solvent chamber through said primary passageway.

26. A condensation vapor degreaser for cleaning parts with a solvent having a detectable flash point comprising:

a solvent chamber containing a supply of hydrocarbon solvent;

a heater for vaporizing said solvent within said solvent chamber;

a cleaning chamber for exposing parts to the solvent vapors;

a door having respective open and closed positions for providing access to said cleaning chamber and for preventing ingress of air and escape of the solvent vapors from said cleaning chamber;

a condenser for condensing the solvent vapors;

a primary passageway for connecting said solvent chamber to said condenser independently of said cleaning chamber when said door is opened; and a secondary passageway for connecting said solvent chamber to said condenser through said cleaning chamber when said door is closed wherein said primary and secondary passageways are respectively connected to convey solvent vapors form said solvent chamber to said condenser.

27. The condensation vapor degreaser of claim 26 wherein said hydrocarbon solvent is selected from a group consisting of linear and branched aliphatic hydrocarbons, mineral spirits, aromatic hydrocarbons, terpenes, linear and branched olefins, cyclic olefins, or alicyclic aliphatic hydrocarbons.

28. The condensation vapor degreaser of claim 27 wherein said selected hydrocarbon solvent is biodegradable.

* * * * *